166-250 SR

9/16/80 OR 4,222,438

United States Patent [19]

Hollingsworth et al.

[11] 4,222,438

[45] Sep. 16, 1980

[54] RESERVOIR FLUID SAMPLING METHOD AND APPARATUS

[75] Inventors: Frank H. Hollingsworth; Lawrence N. Mower, both of Tulsa, Okla.

[73] Assignee: Standard Oil Company (Indiana), Chicago, Ill.

[21] Appl. No.: 955,848

[22] Filed: Oct. 30, 1978

[51] Int. Cl.[2] ..... E21B 47/00

[52] U.S. Cl. ..... 166/250; 166/64; 166/106; 166/264; 166/313; 166/113

[58] Field of Search ..... 166/264, 250, 113, 254, 166/100, 106, 64, 313; 73/155, 151, 154

[56] References Cited

U.S. PATENT DOCUMENTS

| | | | |
|---|---|---|---|
| 3,308,882 | 3/1967 | Lebourg | 166/264 X |
| 3,323,360 | 6/1967 | Nutter | 166/264 |
| 3,327,781 | 6/1967 | Nutter | 166/250 |
| 3,478,584 | 11/1969 | Strubhar et al. | 166/250 X |
| 3,482,628 | 12/1969 | Griffin, Jr. | 166/264 X |
| 3,530,711 | 9/1970 | Tocanne | 166/264 X |
| 4,006,630 | 2/1977 | Cathriner | 73/155 |

*Primary Examiner*—Stephen J. Novosad

*Attorney, Agent, or Firm*—John D. Gassett

[57] ABSTRACT

Determinations are made of the conditions in a fluid-containing well penetrating a fluid-producing subterranean reservoir by isolating an interval in the well which penetrates the fluid-producing reservoir, withdrawing fluid from the interval and determining conditions such as fluid composition, pressure build-up, and temperature in the interval. The interval is isolated with a packing member surrounding an open conduit means extending in the well from the top of the well to a location adjacent the reservoir. Fluid moves from the reservoir into the conduit means and is withdrawn from the conduit means through an opening in the conduit means above and adjacent the lower end of the conduit means. Determinations are made by lowering measuring tools through the tubing string to a location in the well below the opening through which fluid is withdrawn from the conduit means.

6 Claims, 5 Drawing Figures

RESERVOIR FLUID SAMPLING METHOD AND APPARATUS

BACKGROUND OF THE INVENTION

Many tools and techniques have been developed for determining the conditions in wells penetrating subterranean reservoirs. Tools have been developed that can measure and record temperatures and pressures or take samples of fluids at remote locations in the well. Techniques have been developed for using these tools to obtain valuable information concerning the condition in the subterranean reservoirs adjacent the well.

It is now desirable to determine the conditions in subterranean formations during such enhanced oil recovery projects as micellar and miscible gas floods. It is desirable to have a knowledge of such conditions as fluid composition, temperature and pressure at reservoir conditions. Producing wells or dedicated observation wells may be used for determining these conditions.

SUMMARY OF THE INVENTION

Conditions in a fluid-containing well penetrating a fluid-producing subterranean reservoir are determined by isolating a fluid-producing interval in the well, withdrawing fluid from the interval, and determining conditions in the interval. This can be accomplished through a sampling tubing string which includes a packing member located above and adjacent the lower end of the sampling string and a production tubing string in fluid communication with the sampling string. The strings are in fluid communication through an opening in the sampling string above and adjacent the lower end of the sampling string. Fluid enters the lower end of the sampling string and is withdrawn through the production string. The conditions in the well are determined by lowering tools through the sampling string to a location below and adjacent the opening through which fluid is in communication between the tubing strings.

DESCRIPTION OF THE PREFERRED EMBODIMENTS

The present invention provides apparatus and methods for determining the conditions in a wellbore such as a wellbore penetrating a subterranean reservoir in which an enhanced oil recovery project is being conducted. The present invention can be used for determining such conditions as fluid composition, temperature and pressure at reservoir conditions, and for determining pressure build-up in an artificial lifted producing well. As will be further illustrated with respect to the drawings, the conditions are determined by isolating an interval in a fluid-containing well which penetrates and is in fluid communication with a fluid-producing subterranean reservoir, withdrawing fluid from the isolated interval and determining conditions in the isolated interval. When fluid is withdrawn from the isolated interval, it will be replaced by fluid from the formation surrounding the well. By using the apparatus and performing the method of the present invention, the properties of the fluids in the formation surrounding the well can be determined. The apparatus and method of the present invention are suitable for determining the properties of fluids in formations surrounding perforated, cased intervals in wells or surrounding open holes.

Apparatus suitable for performing the method of the present invention has a tubing string or other conduit means extending from the top of the well to a location in the well for providing communication between the top of the well and the interior of the well at that location. The conduit means includes a packer means above and adjacent the lower end of the conduit for sealing the annulus between the conduit means and the surface of the well. The apparatus also includes a rod pump in a second tubing string or other suitable fluid transferring means in fluid communication with the interior of the conduit means through an opening in the conduit means above and adjacent the lower end of the conduit means. The fluid transferring means is suitable for withdrawing fluid from the conduit means and for transferring the fluid to a level in the well above the packer means. Various means can be lowered through the conduit means to a location below the opening and adjacent the lower end of the conduit means for determining conditions in the well adjacent the lower end of the conduit means.

Figure 1:
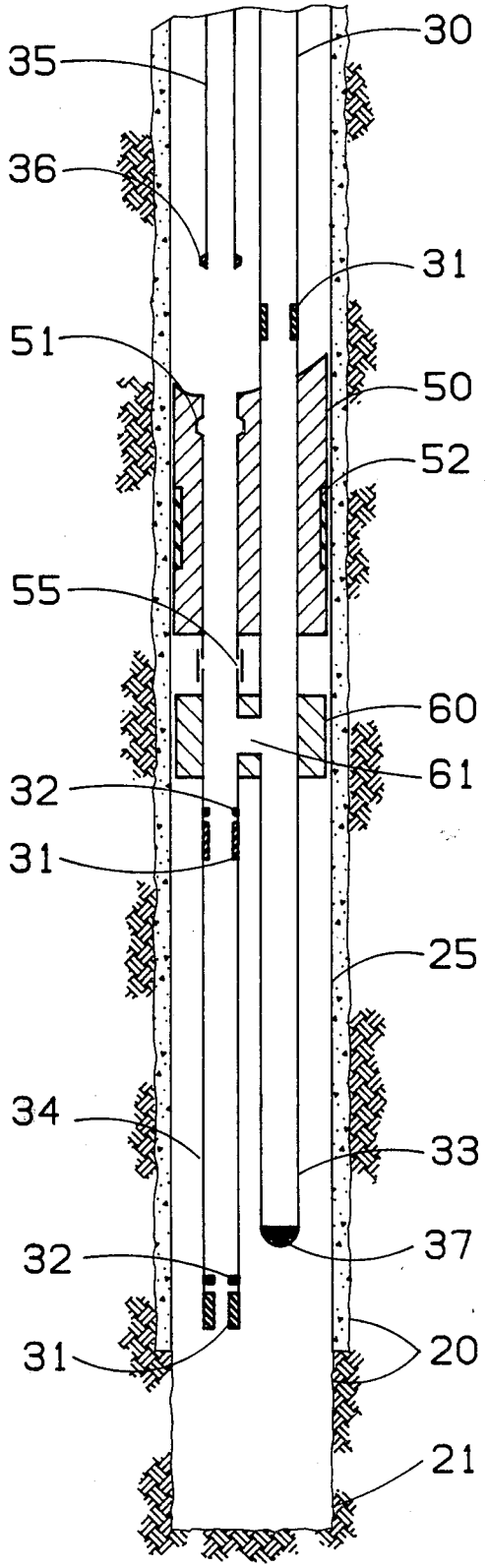
FIGS. 1 and 2 are schematic vertically sectioned views of a portion of a well with apparatus arranged in accordance with the present invention.

The placement of apparatus of the present invention in a well is illustrated in FIG. 1. A long tubing string 30 is in a wellbore 20 which is sealed with a casing 25 down to an open hole 21. The open hole 21 extends into a subterranean reservoir. Attached to the lower end of the long tubing string is a full-opening dual packer 50 with apparatus extending below the packer to effect the present invention. Both openings through the packer are full-opening for the tubing size for which the packer is designed. Thereby, the packer will not restrict the movement of an elongated object such as a testing or logging tool through a tubing string connected to the top of the packer and through the packer.

Below the packer is a full-opening dual tubing anchor 60 with a cross over flow port 61. Connecting the dual packer 50 and dual tubing anchor 60 are suitable pipe nipples and a telescoping swivel sub 55. Immediately below the long string and extending downward from the tubing anchor is a joint of tubing with bull plug 37 in the lower end thereof to function as a mud anchor 33. Extending downwardly from the other opening in the tubing anchor 60 is a length of open tubing 34. This length of open tubing is illustrated in FIG. 1 as being equipped at a location below and adjacent the tubing anchor 60 and at the lower end of the open tubing with sealing surface 31 and shoulder 32. The open tubing 34 can be assembled with commercially available seating nipples that have a locking groove and a seating surface to provide these shoulders and sealing surfaces.

Figure 2:
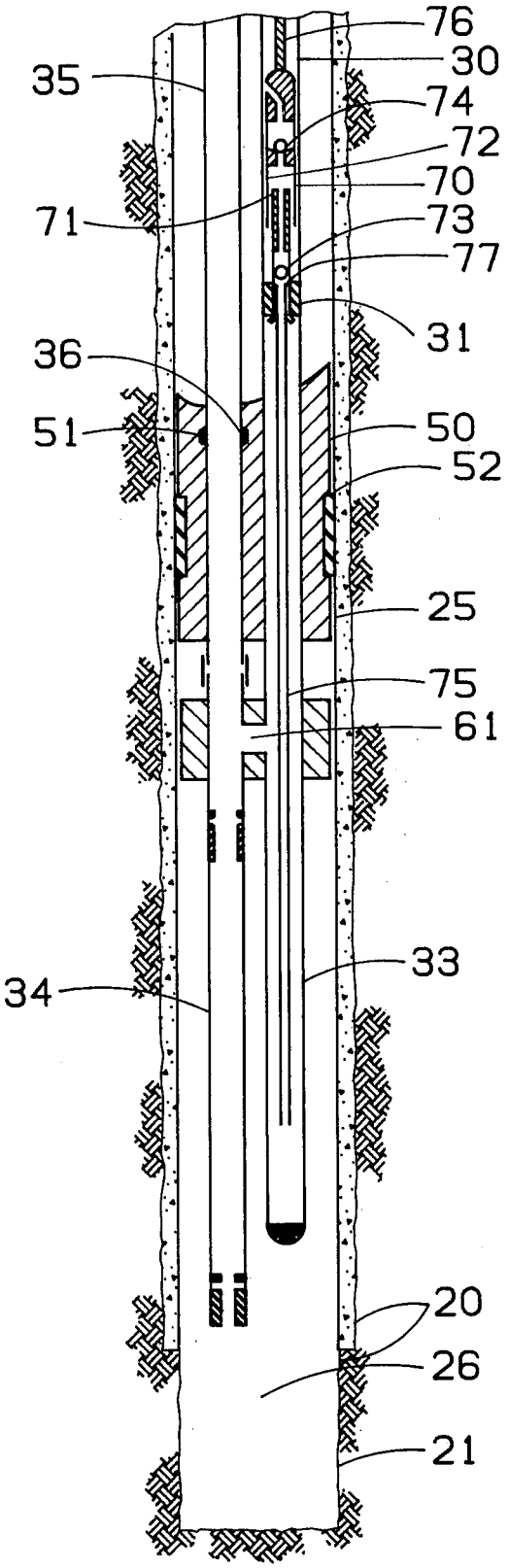

The dual packer 50 illustrated in FIG. 1 is the type that the packing element 52 is activated by the weight of the short tubing string 35. Other suitable packers could be selected that would use means other than the weight of the short string for activating a packing element 52. The dual packer also has a locking groove 51 for providing a positive connection between the short string 35 and the packer 50. The lower end of the short string is fitted with suitable snap latch 36 for securely connecting the short tubing string to the dual packer 50. The connection of the short tubing string to the dual packer 50 is illustrated in FIG. 2, where the snap latch 36 at the lower end of the short tubing string is expanded into the locking groove 51 to provide a secure connection between the short string 35 and the packer 50. Also illustrated in this figure is the packing element 52 being in wall engaging relationship with the casing 25. In this embodiment, the packing element is activated by applying weight on the dual packer 50 with the short string 35.

The rod pump 70 for withdrawing fluid from the interval below the packer is also ilustrated in FIG. 2. The rod pump 70 is shown in FIG. 2 as having a stationary plunger 71 and a traveling barrel 72. In the operation of rod pump 70, traveling valve 74 is normally in the closed position during the upward stroke of the traveling barrel 72. This reduces the pressure within the pump 70 and permits fluid from the subterranean reservoir adjacent open hole 21 to flow into the pump. The standing valve 73 is normally in the closed position and the traveling valve 74 is normally in the open position during the downward stroke of the traveling barrel 72. During the downward stroke, the fluid is transferred from pump 70 through traveling valve 74 into the long tubing string 30.

This pump 70 is operated with a sucker rod 76 and is secured in tubing string 30 by a friction fit between a fibrous sealing surface 77 at the lower end of the rod pump 70 and sealing surface 31 that has a smaller diameter at the bottom than at the top to provide a tapered sealing surface. Extending below the rod pump 70 is a gas anchor 75 which can be small diameter tubing. The gas anchor extends below the cross over 61 to provide a flow path for fluids entering the wellbore at open hole 21 and being withdrawn by the rod pump. Gas in the fluid will have an opportunity to separate from the fluid before the fluid enters the gas anchor 75. The separated gas would be produced through the short string 35.

Dual packer 50, as illustrated in FIG. 2 with its packing element 52 in wall engaging relationship with casing 25, isolates the fluid in wellbore 20 which is below the packer from fluid which is above the packer. The portion of wellbore 20 below the packer 50 is referred to herein as the isolated interval 26.

Figure 3:
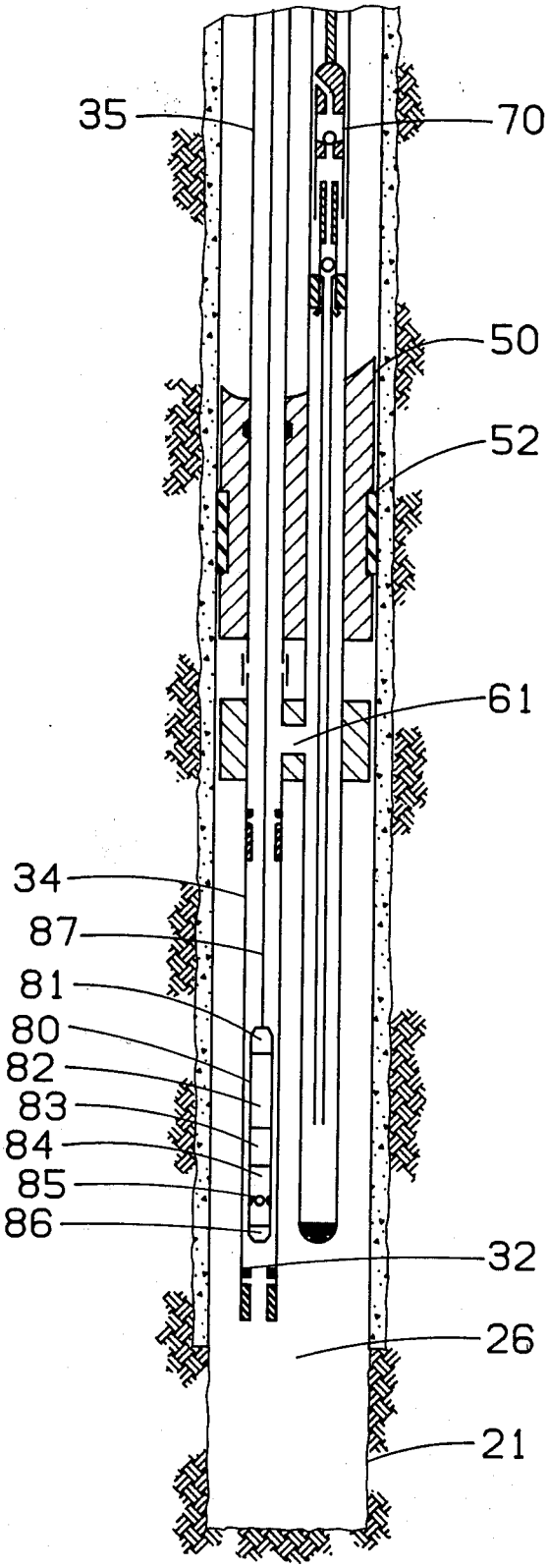
FIG. 3 is a schematic vertically sectioned view of a portion of a well with apparatus for determining the properties of fluid flowing into a well.

The isolated interval 26 below the packer has the necessary apparatus associated therewith for determining the conditions in the isolated interval during the withdrawal of fluid from the interval. This is illustrated in FIG. 3 where a testing tool 80 is shown suspended on a wireline 87 in the isolated interval 26. The testing tool is illustrated as having a maximum reading thermometer 86, a sampling bomb 84 with sampling ports 85, a preset timer 83 for opening and closing the sampling ports 85, a recording pressure gauge 82, and a wireline rope socket 81 for securing the testing tool to the wireline 87.

In one method of using the testing tool 80, sufficient fluid is withdrawn through the rod pump 70 from the isolated interval 26 such that the fluid in the isolated interval is replaced by fluid in the reservoir adjacent the open hole 21. The testing tool is then lowered into the isolated interval until it engages shoulder 32 at the lower end of the open tubing 34. This shoulder is sufficient to prevent the testing tool from passing the shoulder. The tool is lowered until it comes to rest on the shoulder and is then lifted a short distance above the shoulder. This provides a positive indication that the testing tool 80 is between the cross over 61 and the shoulder 32. The withdrawal of fluid from the isolated interval can be continued or terminated as the conditions in the isolated interval are determined. This testing tool can provide information as to the composition of the fluid flowing past the isolated interval as well as pressure changes and the maximum temperature in the isolated interval.

Termination of withdrawal after the withdrawal of fluid equal to about the volume of the isolated interval is desirable such that the disturbance of crude oil displacing fluids such as micellar fluid and mobility buffer fluid is minimized. However, withdrawal of fluid in excess of one volume of the isolated interval may be desired to assure that conditions in the isolated interval closely approximate conditions in the reservoir adjacent the isolated interval. Withrawal of such fluid as micellar fluid or mobility buffer fluid decreases the volume of these fluids which is available for displacing crude oil and the withdrawal of the large volumes can alter flow patterns in the reservoir.

Figure 4:
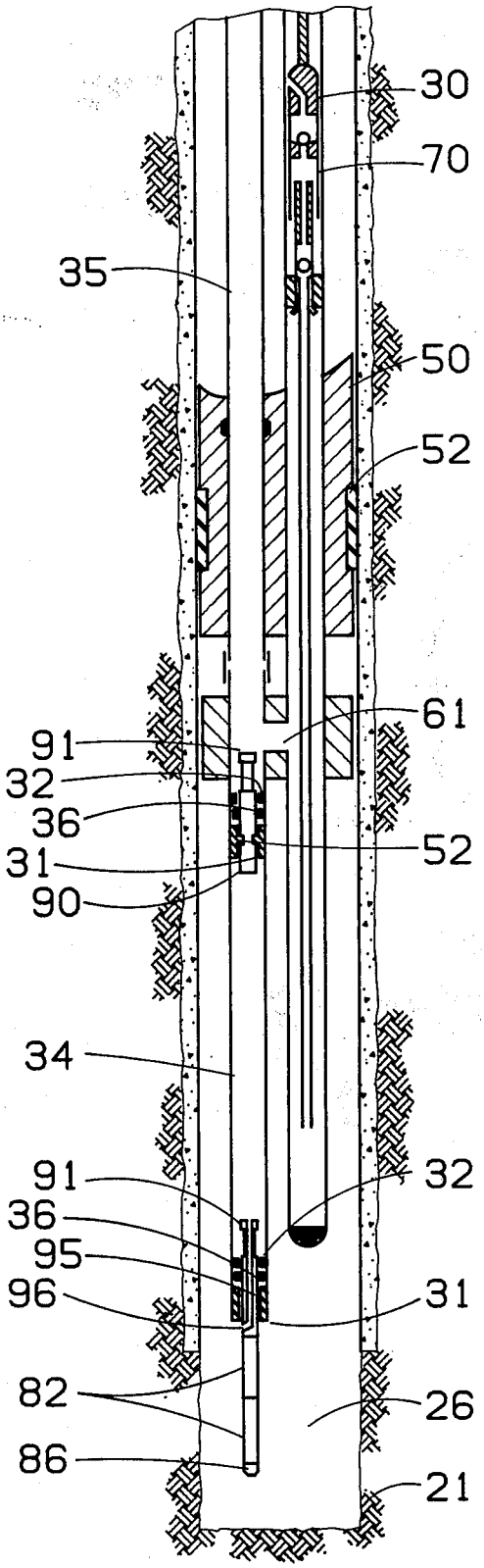
FIG. 4 is a schematic vertically sectioned view of a portion of a well with apparatus for determining conditions in a shut-in well.

The use of the apparatus of the present invention for determining the conditions in a shut-in well is illustrated in FIG. 4. In this figure, it is shown that two recording pressure gauges 82 and a maximum reading thermometer 86 are suspended at the lower end of the open tubing 34. These instruments are suspended on an instrument hanger 95 which is shown as having locking devices 36 for engaging the shoulder 32 and the sealing surface 31. The instrument hanger 95 also has suitable means such as flow passage 96 to permit movement of fluid from the reservoir adjacent open hole 21 into the open tubing 34 and a fishing head 91 for convenience in placing and removing the instrument hanger. The instrument hanger can be placed and removed by the use of special tools on a wireline.

The isolated interval 26 is shown as being sealed with a blanking plug 90 below and adjacent the cross over 61. The blanking plug is shown as having locking devices 36 for engaging the shoulder 32 and the sealing surface 31 of the open tubing 34 immediately below and adjacent the cross over 61 and as having a packing element 52 in wall engaging relationship with the sealing surface 31. The blanking plug 90 is also shown with a fishing head 91 for placing and removing the blanking plug.

The apparatus illustrated in FIG. 4 can be used for determining the conditions in a producing well penetrating a miscible gas drive enhanced oil recovery project. During the withdrawal of fluid from the isolated interval, the instrument hanger 95 along with the recording pressure gauges and maximum reading thermometer is secured in place at the lower end of the open tubing 34. The blanking plug 90 is then secured in place in the open tubing 34 below and adjacent the cross over 61. The packing element 52 of the blanking plug 90 is then activated to seal the fluid in the tubing string 30 and 35 from the fluid in the isolated interval 26. Withdrawal of fluid through rod pump 70 is then terminated and the instruments are left in the isolated interval for a period of time to determine pressure build-up and the maximum temperature in the isolated interval. Additionally, testing tools are commercially available which can be placed in the open tubing 34 below and adjacent the cross over 61 which have means for sealing the open tubing string such as at sealing surface 31 and for providing pressure readings at the surface.

Figure 5:
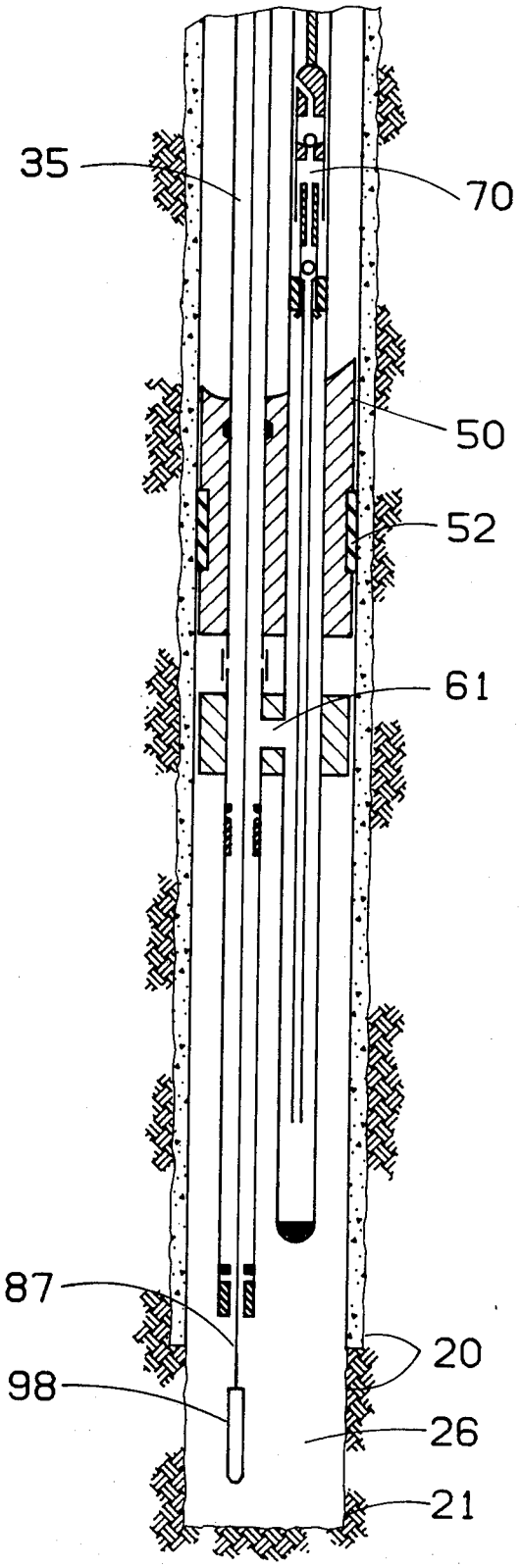
FIG. 5 is a schematic vertically sectioned view of a portion of a wellbore with apparatus for determining the level which fluid flows into an open hole.

The use of the apparatus of the present invention for determining conditions such as the contribution of the different levels of the subterranean reservoir adjacent open hole 21 to production is illustrated in FIG. 5. It is shown that a logging tool 98 is suspended on a wireline 87 in the open hole 21 portion of the isolated interval 26. Commercially available mechanical and nuclear logging tools are suitable for use in performing the method of the present invention. These logging tools could be moved through the openhole 21 while withdrawing fluid through rod pump 70 to obtain a measurement of the quantity of fluid entering the wellbore at different levels of a subterranean reservoir adjacent openhole 21.

It can be seen by the described embodiments that the method and apparatus of the present invention offer many advantages over prior art techniques of obtaining samples while at the same time having the ability to produce a well by pumping. By the use of the apparatus and method of the present invention, samples can readily be obtained during rod pumping of a production well such as a waterflood or enhanced oil recovery production well. In a dedicated observation well in a waterflood or enhanced oil recovery project, the method and apparatus of the present invention enables the operator to obtain reservoir samples and otherwise monitor reservoir conditions with the withdrawal of small quantities of fluid from the reservoir.

Only one isolated interval is illustrated in the embodiments described in this application and the wells shown and described in these embodiments are not equipped with apparatus other than the apparatus for performing the present invention. However, it is contemplated that the method and apparatus of the present invention can be used for determining conditions in multiple isolated intervals within a well and that the method of the present invention can be performed in conjunction with other operations in a well such as producing from intervals above or below the isolated interval. These tools provide the capability of monitoring pressure build-up at the surface. It is also contemplated that the apparatus and method of the present invention can be used for determining conditions in isolated intervals which are in fluid communication with a formation adjacent the interval by any suitable means such as the open hole as is illustrated in the drawings of this application or by means of a perforated casing.

While certain embodiments of the present invention have been described for illustrative purposes, the invention is not limited thereto. Various modifications or embodiments of the invention will be apparent to those skilled in the art in view of this disclosure. Such modifications or embodiments are within the spirit and scope of the disclosure.

What is claimed is:

1. A method of determining conditions in a fluid-containing well which penetrates a fluid-producing interval, which comprises extending conduit means from the top of said well to a location in said well above and adjacent at least a portion of said fluid-producing interval for providing communication between the top of said well and the interior of said well at said location;

isolating at least a portion of said fluid-producing interval in said well with packer means above and adjacent the lower end of said conduit means for sealing the annulus between said conduit means and the surface of said well;

withdrawing fluid from said isolated interval with fluid transferring means in fluid communication with the interior of said conduit means through an opening in said conduit means, wherein said opening is above and adjacent the lower end of said conduit means; and determining conditions in said isolated interval by lowering means for determining said conditions through said conduit means to a location in said interval below said opening.

2. A method of determining conditions in a fluid-containing well which penetrates and is in fluid communication with a fluid-producing subterranean reservoir, which comprises:

extending a tubing string from the top of said well to a location in said well above and adjacent at least a portion of said reservoir;

isolating at least a portion of said reservoir in said well with a packer connected to the lower end of said tubing string, wherein said packer has a packing member in wall engaging relationship with the surface of said well for providing a fluid tight seal in the annulus between said packer and the surface of said well and having an opening therethrough immediately below said tubing string that will not restrict the movement of an elongated object through said tubing string and said packer;

extending a conduit downwardly from said packer immediately below said tubing string, said conduit having an opening therethrough that will not restrict the movement of said elongated object therethrough, said conduit, packer and tubing string comprising a sampling string;

withdrawing fluid from the interior of said sampling string at a location adjacent said packer and transferring said withdrawn fluid to a level in said well above said packer; and determining conditions in said well with a tool for determining conditions in said well, wherein said tool is lowered through said sampling string to a location adjacent and below the level wherein fluid is withdrawn from said sampling string.

3. A method of determining conditions in a fluid-containing well which penetrates and is in fluid communication with a fluid-producing subterranean reservoir, which comprises:

extending first and second tubing strings from the top of said well to a location in said well above and adjacent at least a portion of said reservoir;

isolating at least a portion of said reservoir in said well with a dual packer connected to the lower end of said tubing strings, wherein said packer has a packing member in wall engaging relationship with the surface of said well for providing a fluid tight seal in the annulus between said packer and the surface of said well and having an opening therethrough immediately below said first tubing string that will not restrict the movement of an elongated object through said first tubing string and said packer;

extending a conduit downwardly from said packer immediately below said first tubing string, said conduit having an opening therethrough that will not restrict the movement of said elongated object therethrough;

withdrawing fluid from said conduit at a level above the lower end of said conduit and transferring said fluid through said second tubing string to the top of said well; and determining conditions in said well with a tool for determining conditions in said well at a level below the location wherein fluid is withdrawn from said conduit and adjacent the lower end of said conduit, wherein said tool is lowered through said first tubing string, packer and at least part of the way through said conduit to a location below the level wherein fluid is withdrawn from said conduit and adjacent the lower end of said conduit.

4. Apparatus for determining conditions in a fluid-containing well penetrating a fluid-producing interval, which comprises:

conduit means extending from the top of said well to a location in said well above and adjacent at least a portion of said fluid-producing interval for providing communication between the top of said well and the interior of said well at said location, packer means above and adjacent the lower end of said conduit means for sealing the annulus between said conduit means and the surface of said well, fluid transferring means in fluid communication with the interior of said conduit means through an opening in said conduit means for withdrawing fluids from said conduit means, wherein said opening is above and adjacent the lower end of said conduit means; and means lowered through said conduit means to a location below said opening for determining conditions in said well.

5. Apparatus for determining conditions in a fluid-containing well which penetrates and is in fluid communication with a fluid-producing subterranean reservoir, which comprises:

a tubing string extending from the top of said well to a location in said well above and adjacent at least a portion of said reservoir, a packer connected to the lower end of said tubing string, said packer having a packing member in wall engaging relationship with the surface of said well for sealing the annulus between said packer and the surface of said well to prevent fluid communication in said well between the bottom and top of said packer and having an opening therethrough immediately below said tubing string that will not restrict the movement of an elongated object through said tubing string and said packer, a conduit extending downwardly from said packer immediately below said tubing string, said conduit having an opening therethrough that will not restrict the movement of said elongated object therethrough, said tubing string, packer and conduit comprising a sampling string, fluid transferring means in fluid communication with the interior of said sampling string at a location adjacent said packer for withdrawing fluid from the interior of said sampling string and transferring said withdrawn fluid to a level in said well above said packer, and a tool for determining conditions in said well which is suspended on a wireline extending through said sampling string, to a location below the level wherein the fluid transferring means is in fluid communication with the interior of said sampling string.

6. Apparatus for determining conditions in a fluid-containing well which penetrates and is in fluid communication with a fluid-producing subterranean reservoir, which comprises:

first and second tubing strings extending from the top of said well to a location in said well above and adjacent at least a portion of said reservoir, a dual packer connected to the lower end of said tubing strings, said packer having a packing member in wall engaging relationship with the surface of said well and having an opening therethrough immediately below said first tubing string that will not restrict the movement of an elongated object through said first tubing string and said packer, a conduit extending downwardly from said packer immediately below said first tubing string, said conduit having an opening therethrough that will not restrict the movement of said elongated object therethrough, means connected to said packer and said conduit and in fluid communication with the interior of said conduit for providing fluid communication between the interior of said conduit and said second tubing string, a rod pump means secured in said second tubing string adjacent said packer for transferring fluid from the interior of said conduit to a level in said second tubing string above said rod pump means, and a tool means for determining conditions in said well, wherein said tool means is suspended on a wireline extending through said first tubing string, said packer and at least a portion of the way through said conduit to a location below the level wherein said fluid transferring means is in fluid communication with the interior of said conduit.

* * * * *